US010090122B2

(12) United States Patent
Liang

(10) Patent No.: US 10,090,122 B2
(45) Date of Patent: Oct. 2, 2018

(54) LOW PROFILE KEYBOARD BACKLIGHT MODULE

(71) Applicant: CHICONY POWER TECHNOLOGY CO., LTD., New Taipei (TW)

(72) Inventor: Hsin-Chih Liang, New Taipei (TW)

(73) Assignee: CHICONY POWER TECHNOLOGY CO., LTD., New Taipei (TW)

( * ) Notice: Subject to any disclaimer, the term of this patent is extended or adjusted under 35 U.S.C. 154(b) by 360 days.

(21) Appl. No.: 14/792,198

(22) Filed: Jul. 6, 2015

(65) Prior Publication Data

US 2017/0011870 A1 Jan. 12, 2017

(51) Int. Cl.
*H01H 13/83* (2006.01)
*H01H 13/704* (2006.01)

(52) U.S. Cl.
CPC ..... *H01H 13/83* (2013.01); *H01H 13/704* (2013.01); *H01H 2201/028* (2013.01); *H01H 2209/074* (2013.01); *H01H 2215/006* (2013.01); *H01H 2219/048* (2013.01); *H01H 2219/052* (2013.01); *H01H 2227/036* (2013.01)

(58) Field of Classification Search
CPC ..... H01H 13/83; H01H 13/704; H01H 2201/028; H01H 2209/074; H01H 2215/006; H01H 2219/048; H01H 2219/052; H01H 2227/036
See application file for complete search history.

(56) References Cited

U.S. PATENT DOCUMENTS 5,797,482 A * 8/1998 LaPointe ..... H01H 13/702 200/278
6,198,217 B1 * 3/2001 Suzuki ..... H05B 33/04 313/504
7,049,536 B1 * 5/2006 Marcus ..... H01H 13/83 200/310
2001/0037933 A1 * 11/2001 Hunter ..... H01H 13/702 200/310
2011/0056814 A1 * 3/2011 Cheng ..... H01H 9/182 200/310
2012/0286976 A1 * 11/2012 Chen ..... H01H 13/83 341/22
2014/0340317 A1 * 11/2014 Rodzeveski ..... G06F 3/048 345/173
2015/0036314 A1 * 2/2015 Cheng ..... H01H 13/83 362/23.03

* cited by examiner

*Primary Examiner* — Jill Culler
*Assistant Examiner* — Marissa Ferguson Samreth
(74) *Attorney, Agent, or Firm* — Muncy, Geissler, Olds & Lowe, P.C.

(57) ABSTRACT

A low profile keyboard backlight module includes an electrically insulative bottom membrane layer, an intermediate membrane layer including a conducting layer, an insulative layer and a light-emitting layer attached together through lamination and bonded to the top surface of the bottom membrane layer, and an electrically insulative top membrane layer bonded to a top surface of the intermediate membrane layer opposite to the bottom membrane layer and having an integrated elastic layer located at a top surface thereof to support a set of keys. Thus, the low profile keyboard backlight module provides optimal waterproof effects and is practical for use in an electronic product having light, thin, short and small characteristics.

6 Claims, 7 Drawing Sheets

LOW PROFILE KEYBOARD BACKLIGHT MODULE

BACKGROUND OF THE INVENTION

1. Field of the Invention

The present invention relates to backlight technology and more particularly, to a low profile keyboard backlight module, which comprises a bottom membrane layer, a top membrane layer and an intermediate membrane layer sandwiched between the bottom membrane layer and the top membrane layer in a stack and having, a light-emitting layer embedded therein, lowering the overall thickness of the module and providing a waterproof effect.

2. Description of the Related Art

With fast development of the modern technology, many different kinds of electrical and electronic products have been created and widely used in our daily life, bringing comfort and convenience to people and improving the standard of living of the people. The jobs of word processing, photos and graphics editing, presentations, e-mail, Internet linking, and etc. are quite common in our everyday lives, making the application of computer products become more popular. In various electronic works through a computer system, one must input data through a keyboard, so that the host of the computer system can start processing according to the inputted data. Therefore, a computer keyboard has become an essential tool for the computer jobs. It is now the market trend to design computers and peripheral apparatuses having light, thin, short and small characteristics and enhanced functions, the overall thickness of a computer, more particularly, notebook computer, must be greatly reduced. In consequence, the thickness of computer display screens and keyboards must also be greatly reduced. Nowadays, low profile membrane keyboards have been widely used in various computer products to replace conventional mechanical keyboards. Further, a computer keyboard may have a light source mounted therein for emitting light to each key switch that is pressed by the user so that the user can clearly identify the location of the key that is duly pressed. A light-emitting keyboard structure generally comprises a mask layer, a light guide layer and a reflective layer arranged at different elevations under the keys, and a plurality of light-emitting diodes mounted in the circuit board of the light guide layer. The reflective layer is adapted to reflect the emitted light of the light-emitting diodes upwardly. The mask layer masks the reflected light in predetermined areas so that the reflected light can be concentrated and upwardly guided to each pressed key or the area around each pressed key. The mask layer, the light guide layer and the reflective layer constitute a backlight reflecting layer. Further, the mask layer has holes corresponding to the keys of the keyboard so that the reflective layer can reflect the light in the light guide layer toward the keys through the holes in the mast layer. However, a backlight module of this design has a certain thickness so that the light-emitting diodes can be mounted in the light guide layer between the mask layer and the reflective layer. The thickness of the backlight module cannot be further reduced for low profile application.

In order to reduce the height of a keyboard backlight module, some manufacturers adopt an electroluminescent lamp as a light source for keyboard backlight module. By means of applying an electric field to the electroluminescent lamp in the keyboard backlight module, the electroluminescent lamp is energized to emit light. FIG. 6 illustrates a keyboard backlight module according to the prior art. According to this design, the keyboard backlight module comprises a key switch layer A, an electroluminescent layer B, and a substrate C. The key switch layer A and the electroluminescent layer B are respectively mounted at opposing top and bottom surfaces of the substrate C. The substrate C can be a transparent panel member or a stainless steel panel with holes therein. When the electroluminescent layer B is energized, it emits light through the substrate C toward the key switch layer A. However, the fabrication and installation of this design of keyboard backlight module are complicated. Further, this design of keyboard backlight module still has a certain thickness. FIG. 7 illustrates another design of keyboard backlight module according to the prior art. According to this design, the keyboard backlight module comprises an integrated key switch and electroluminescent layer combination D and a substrate C. The integrated key switch and electroluminescent layer combination D comprises an insulative layer, a conducting layer, a light-emitting layer and a lead wire layer D1 arranged together through lamination with the lead wire layer D1 exposed to the outside of the integrated key switch and electroluminescent layer combination D. In actual application, the lead wire layer D1 of the integrated key switch and electroluminescent layer combination D can easily be affected with damp, leading to waterproofing failure. An improvement is necessary.

Therefore, it is desirable to provide a keyboard backlight module that has a low profile and is practical for use in an electronic product having light, thin, short and small characteristics and can effectively protect the conducting components and circuits against damp and mould.

SUMMARY OF THE INVENTION

The present invention has been accomplished under the circumstances in view. It is therefore the main object of the present invention to provide a low profile keyboard backlight module, which has low profile and waterproof characteristics and is practical for use in an electronic product having light, thin, short and small characteristics.

To achieve this and other objects of the present invention, the low profile keyboard backlight module comprises a bottom membrane layer, a top membrane layer and an intermediate membrane layer sandwiched between the bottom membrane layer and the top membrane layer. The bottom membrane layer is an electrically insulative layer. The intermediate membrane layer is laminated on a top surface of the bottom membrane layer, comprising a conducting layer, an insulative layer and a light-emitting layer attached together through lamination. The top membrane layer is an electrically insulative layer bonded to a top surface of the intermediate membrane layer opposite to the bottom membrane layer, comprising an elastic layer located at a top surface thereof and supporting a set of keys. Preferably, the bottom membrane layer is made from MYLAR polyester film.

In one embodiment of the present invention, the conducting layer of the intermediate membrane layer comprises a first conducting layer bonded to the top surface of the bottom membrane layer and a second conducting layer embedded in the insulative layer of the intermediate membrane layer; the insulative layer of the intermediate membrane layer comprises a first insulative layer bonded to a top surface of the first conducting layer opposite to the bottom membrane layer and a second insulative layer bonded between a bottom surface of the bottom membrane layer opposite to the elastic layer and a top surface of second conducting layer opposite to the light-emitting layer; the light-emitting layer is bonded between the first insulative layer of the insulative layer the intermediate membrane layer and the second conducting layer of the conducting layer of the intermediate membrane layer; the top membrane layer comprises a conducting circuit layer located at the bottom surface thereof and compressible by the keys at the elastic layer.

In another embodiment of the present invention, the conducting layer of the intermediate membrane layer comprises a first conducting layer bonded to the top surface of the bottom membrane layer and a second conducting layer bonded to a bottom surface of the top membrane layer and a top surface of the light-emitting layer; the insulative layer of the intermediate membrane layer comprises a first insulative layer bonded between a bottom surface of the light-emitting layer opposite to the second conducting layer and a top surface of the first conducting layer opposite to the bottom membrane layer; the light-emitting layer is bonded between the first insulative layer and the second conducting layer.

Further, the first conducting layer is made from silver paste, having a thickness in the range of 0.01~0.05 mm; the first insulative layer and the second insulative layer are made from UV curable rubber, having a thickness in the range of 0.01~0.05 mm; the light-emitting layer is an electroluminescent sheet containing one of phosphorous and zinc sulfide (ZnS) and made by printing, having a thickness in the range of 0.01~0.05 mm; the second conducting layer is a transparent electrode using anisotropic conductive films (ACFs), or a transparent indium tin oxide (ITO) electrode made by vacuum sputtering deposition technology, having a thickness in the range of 0.01~0.05 mm.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
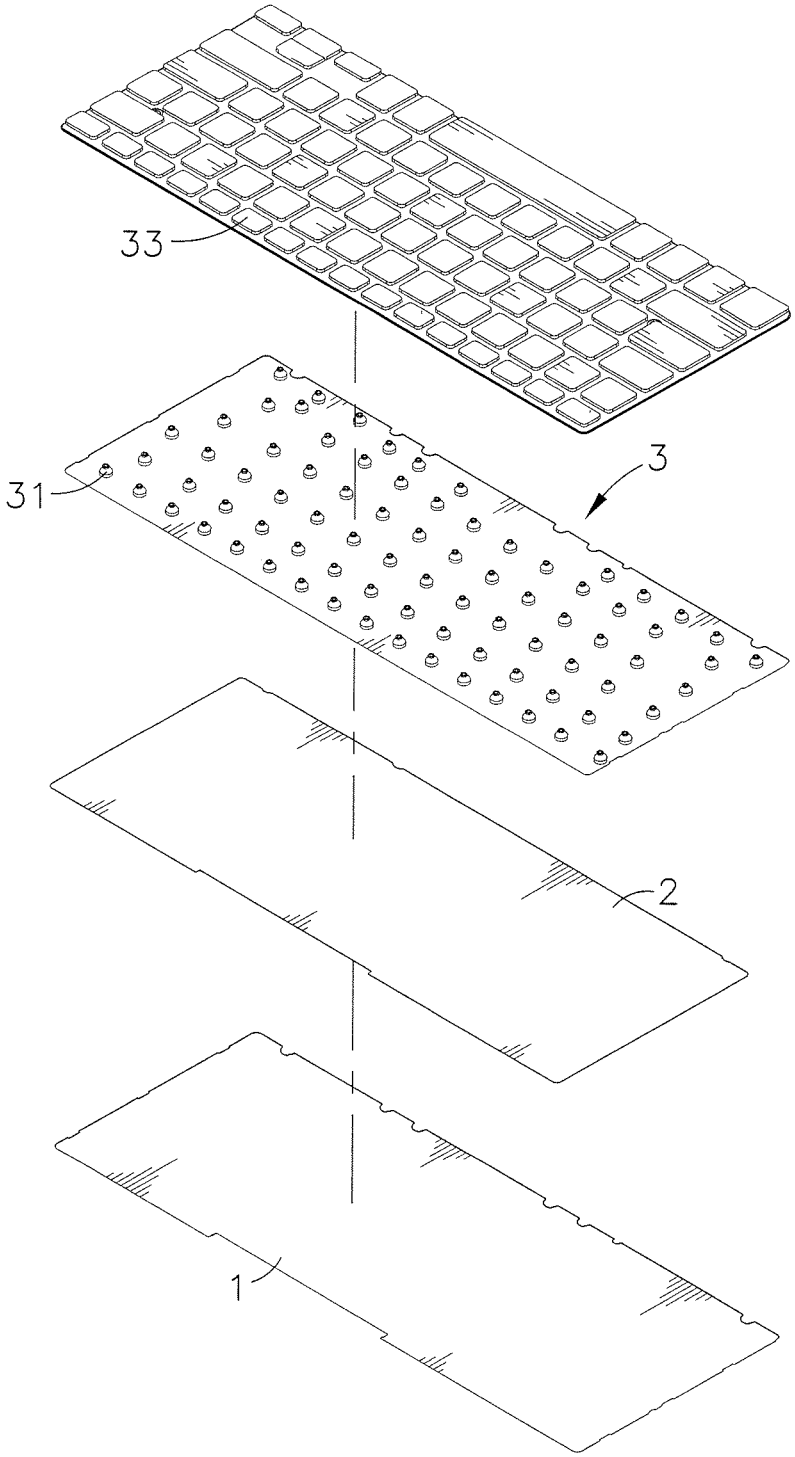
FIG. 1 is an exploded view of a keyboard backlight module in accordance with a first embodiment of the present invention.

Referring to FIGS. 1-5, an exploded view of a keyboard backlight module in accordance with a first embodiment of the present invention, a sectional assembly view of the keyboard backlight module in accordance with the first embodiment of the present invention, an operational view of the keyboard backlight module in accordance with the first embodiment of the present invention, a sectional assembly view of a keyboard backlight module in accordance with a second embodiment of the present invention and an operational view of the keyboard backlight module in accordance with the second embodiment of the present invention are shown. The keyboard backlight module comprises a bottom membrane layer 1, an intermediate membrane layer 2 and a top membrane layer 3.

The bottom membrane layer 1 is made from an insulating material, for example, MYLAR polyester film.

The intermediate membrane layer 2 is a multi-layer member comprising a conducting layer 21, an insulative layer 22 and a light-emitting layer 23 attached together through lamination.

The top membrane layer 3 is made from an insulative material, for example, MYLAR polyester film, comprising an elastic layer 31 located at a top surface thereof and a conducting circuit layer 32 located at an opposing bottom surface thereof. The elastic layer 31 can be, for example, an array of rubber domes.

In installation, the intermediate membrane layer 2 is sandwiched between the bottom membrane layer 1 and the top membrane layer 3. Each layer of the intermediate membrane layer 2 has a thickness within the range of 0.01~0.05 mm. Thus, the keyboard backlight module can have a low profile characteristic, where the laminated structure provides a sealing effect. Mounting the bottom membrane layer 1, the intermediate membrane layer 2 and the top membrane layer 3 together in a stack constitutes the low profile keyboard backlight module of the present invention.

Figure 2:
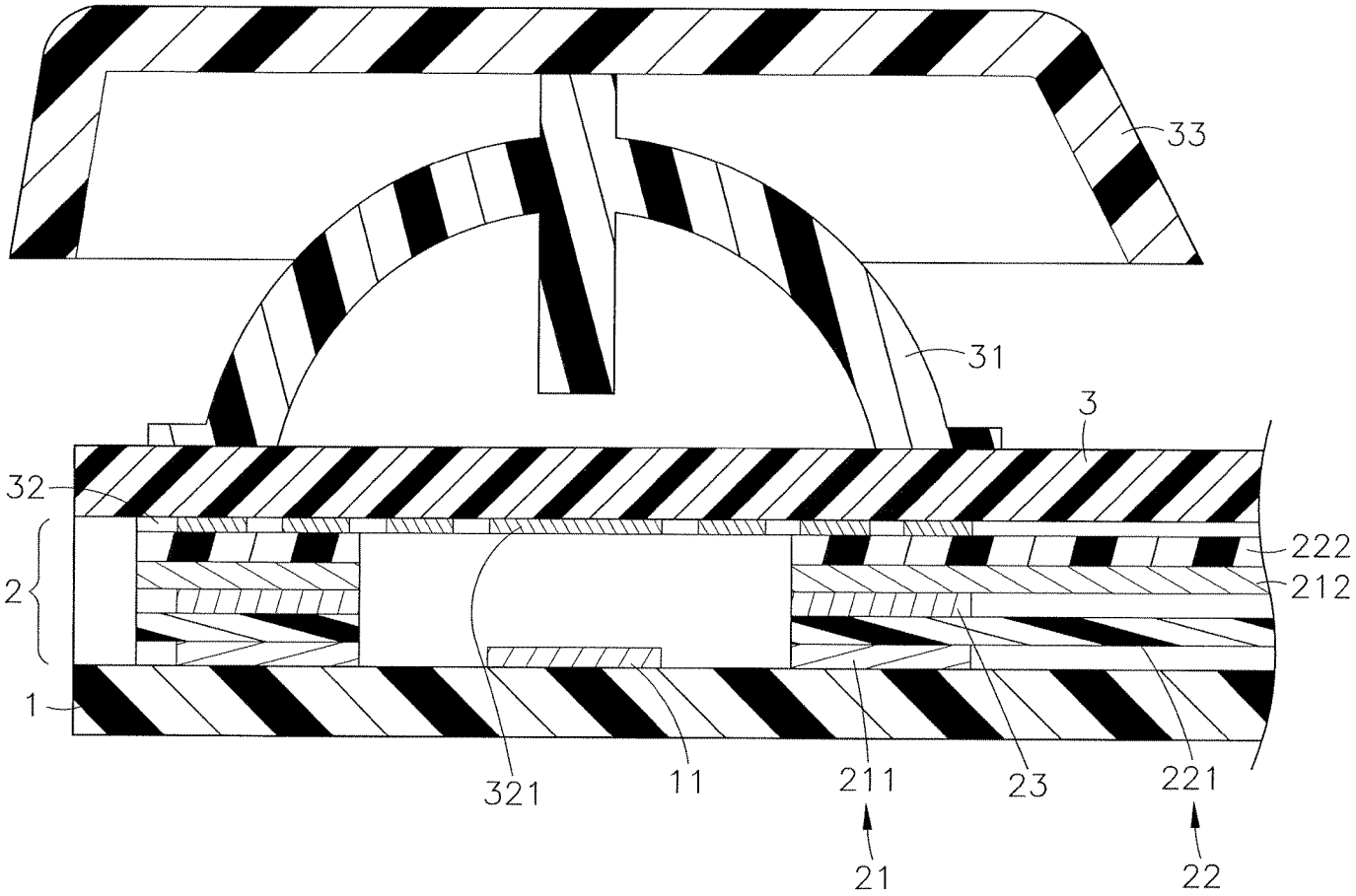
FIG. 2 is a sectional assembly view of the keyboard backlight module in accordance with the first embodiment of the present invention.
Figure 3:
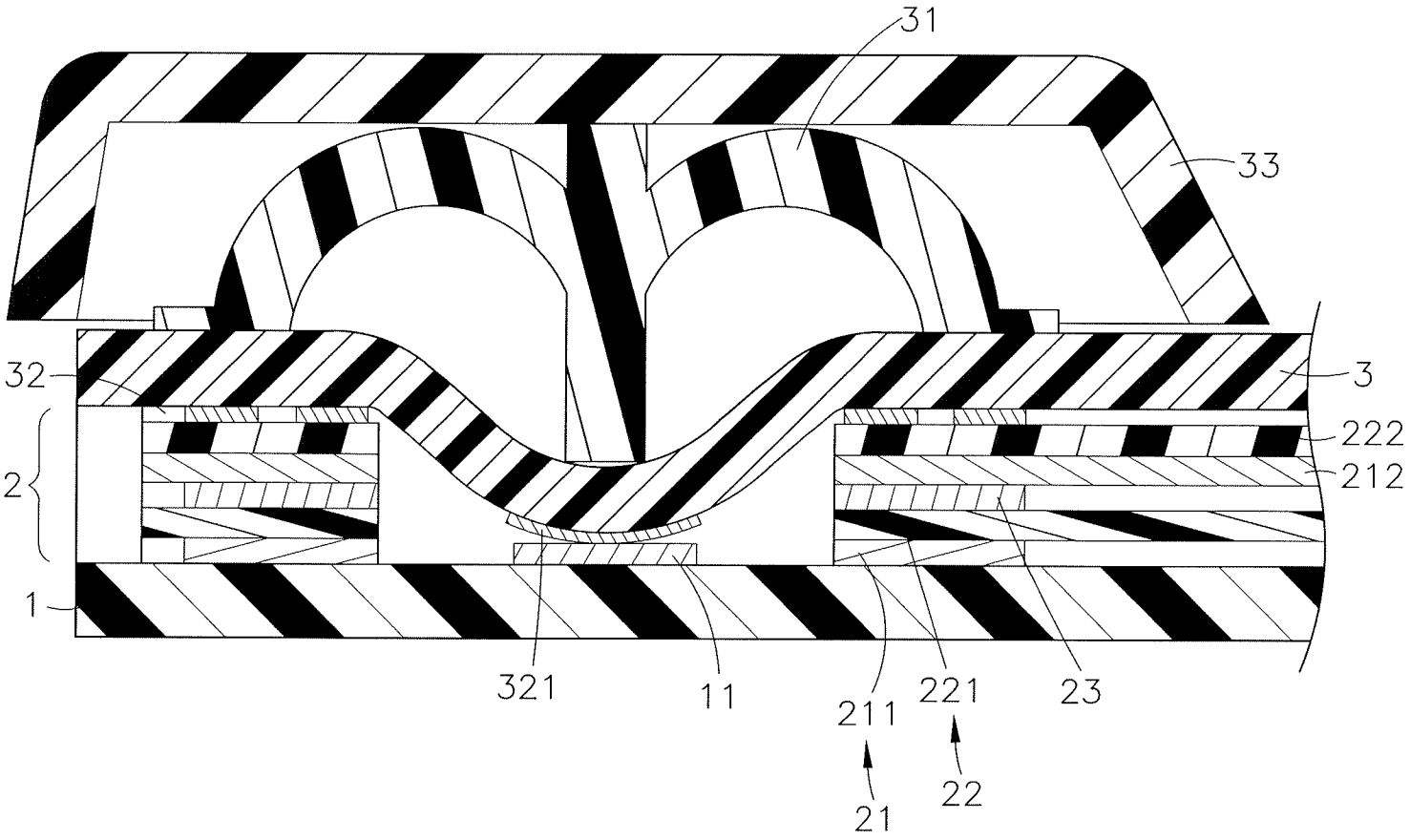
FIG. 3 is an operational view of the keyboard backlight module in accordance with the first embodiment of the present invention.

In the first embodiment shown in FIGS. 2 and 3, the conducting layer 21 of the intermediate membrane layer 2 comprises a bottom membrane layer conducting layer 11 and a first conducting layer 211 integrally formed on a top surface of the bottom membrane layer 1, and a second conducting layer 212 located on a top surface of the light-emitting layer 23; the insulative layer 22 of the intermediate membrane layer 2 comprises a first insulative layer 221 sandwiched between the first conducting layer 211 and an opposing bottom surface the light-emitting layer 23, and a second insulative layer 222 sandwiched between a top surface of the second conducting layer 212 opposite to the light-emitting layer 23 and the conducting circuit layer 32 of the top membrane layer 3. The conducting circuit layer 32 can be selected from silver paste or carbon film for the bonding of the second insulative layer 222. Further, the bottom membrane layer conducting layer 11 and the first conducting layer 211 are made from silver paste by a one-step processing process, having a thickness in the range of 0.01~0.05 mm. The first insulative layer 221 and the second insulative layer 222 can be made from UV curable rubber, having a thickness in the range of 0.01~0.05 mm. The light-emitting layer 23 is an electroluminescent sheet containing phosphorous or zinc sulfide (ZnS) and made by printing, having a thickness in the range of 0.01~0.05 mm. The second conducting layer 212 can be a transparent electrode using anisotropic conductive films (ACFs), or a transparent indium tin oxide (ITO) electrode made by vacuum sputtering deposition technology, having a thickness in the range of 0.01~0.05 mm. As the component layers of the intermediate membrane layer 2 are made in the range of 0.01~0.05 mm, the overall thickness of the intermediate membrane layer 2 can be controlled. After mounting of a set of keys 33 on the top surface of the elastic layer 31 of the top membrane layer 3, the bottom membrane layer 1, the intermediate membrane layer 2 and the top membrane layer 3 are tightly arranged together so that the bottom membrane layer conducting layer 11 of the bottom membrane layer 1, the conducting layer 21 of the intermediate membrane layer 2 and the light-emitting layer 23 are sealed in between the bottom membrane layer 1 and the top membrane layer 3 in a watertight manner, preventing permeation of damp and mould into the inside of the intermediate membrane layer 2 and achieving an optimal waterproof effect and also enhancing the reliability of the product.

If one key 33 at the top surface of the top membrane layer 3 is pressed by an external force, the key 33 gives a downward pressure to the respective rubber dome of the elastic layer 31, forcing one respective first upper electrode 321 of the conducting circuit layer 32 of the top membrane layer 3 to touch the bottom membrane layer conducting layer 11, and thus, the conducting circuit layer 32 and the bottom membrane layer conducting layer 11, producing a switching signal corresponding to the respective key 33.

Figure 4:
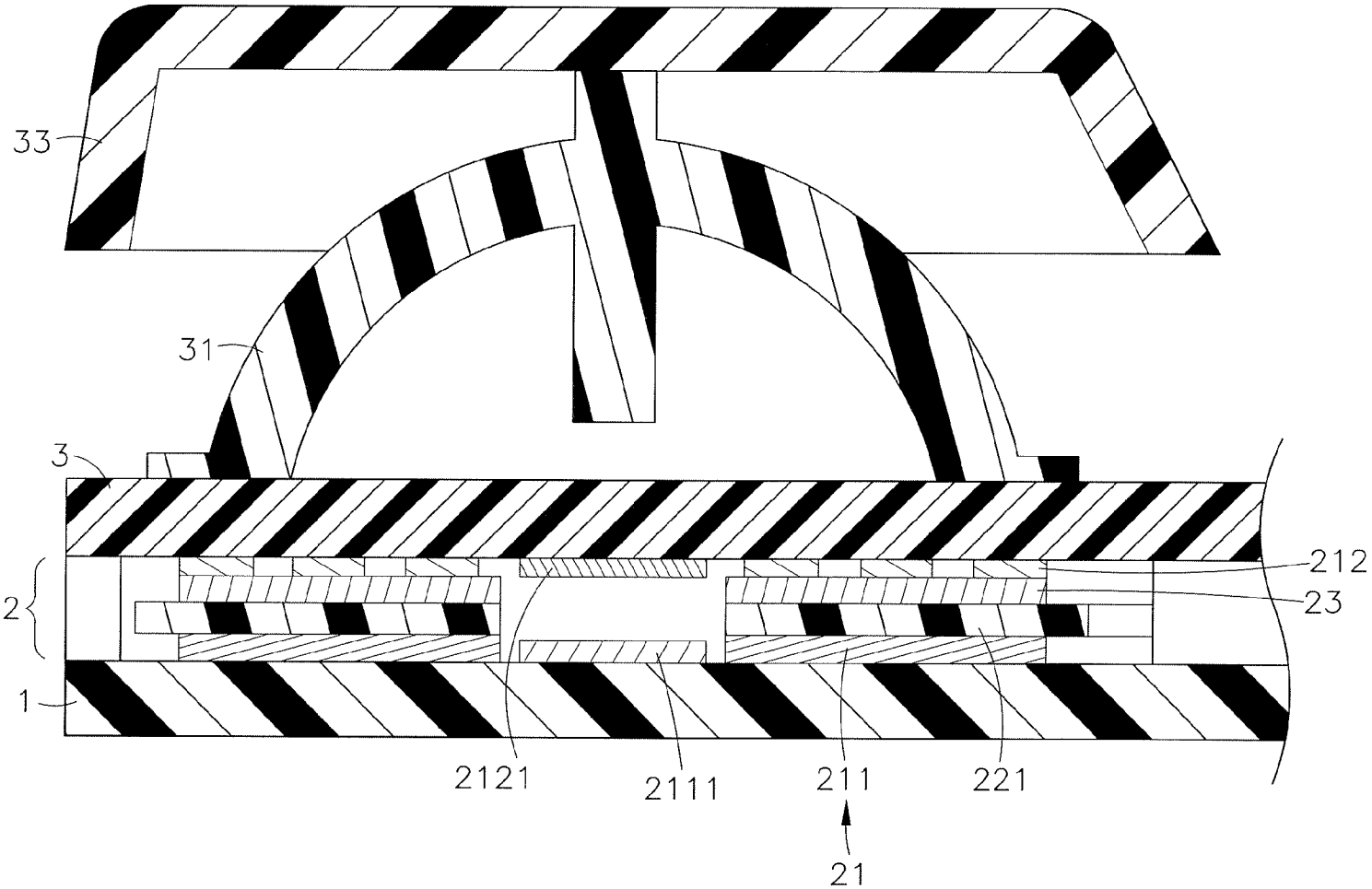
FIG. 4 is a sectional assembly view of a keyboard backlight module in accordance with a second embodiment of the present invention.
Figure 5:
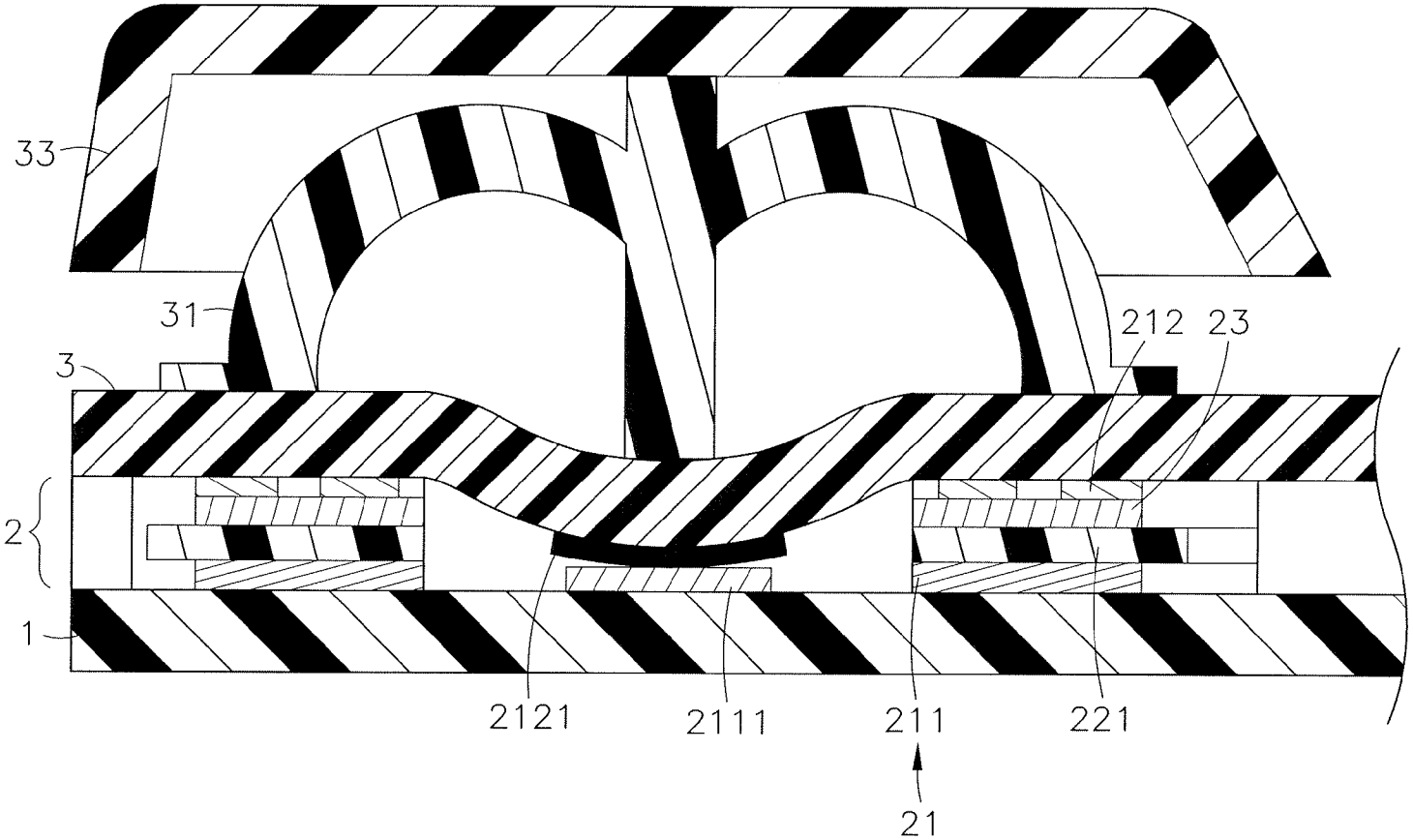
PRIOR ART FIG.5
FIG. 5 is an operational view of the keyboard backlight module in accordance with the second embodiment of the present invention.
Figure 6:
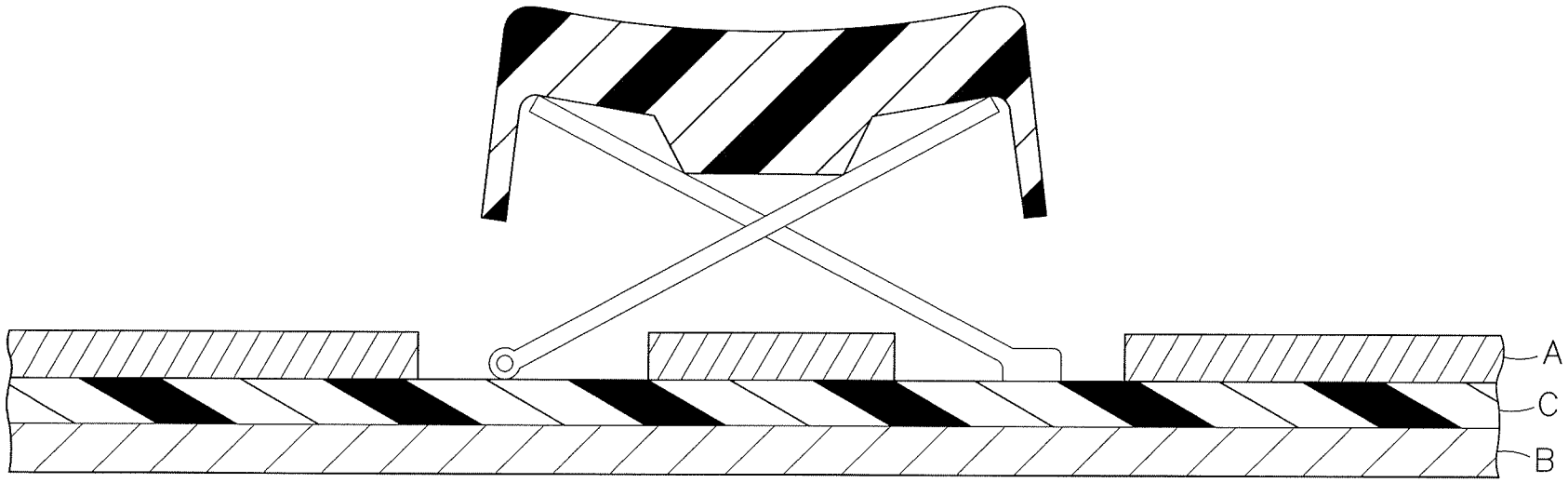
PRIOR ART FIG. 6
FIG. 6 is a sectional side view of a keyboard backlight module according to the prior art.
Figure 7:
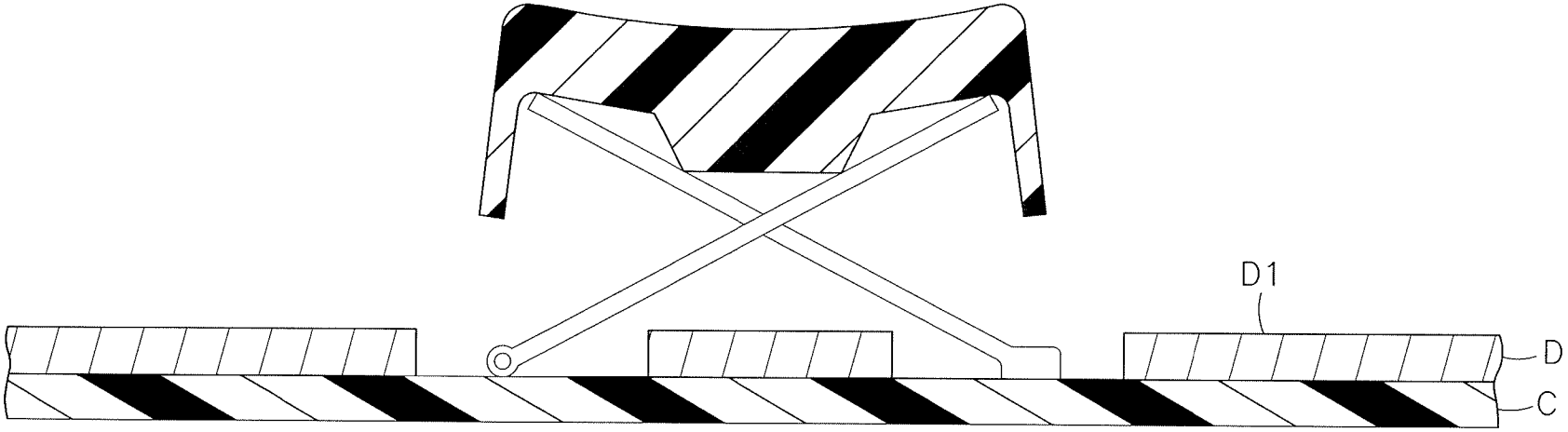
PRIOR ART FIG. 7
FIG. 7 is a sectional side view of another design of keyboard backlight module according to the prior art.

In the second embodiment shown in FIGS. 2-4, the top membrane layer 3 comprises an elastic layer 31 located at a top surface thereof; the bottom side of the top membrane layer 3 is a smooth surface without the aforesaid conducting circuit layer 32; the intermediate membrane layer 2 comprises a conducting layer 21, which comprises a first conducting layer 211 and a plurality of bottom electrodes 2111 integrally formed on the top surface of the bottom membrane layer 1 and a second conducting layer 212 and a plurality of second upper electrodes 2121 bonded to the bottom surface of the top membrane layer 3 with the second upper electrodes 2121 respectively disposed corresponding to the respective bottom electrodes 2111 and the respective rubber domes of the elastic layer 31 and the respective keys 33, an insulative layer 22 comprising a first insulative layer 221 sandwiched between the first conducting layer 211 and the top membrane layer 3 beyond the bottom electrodes 2111, and a light-emitting layer 23 sandwiched between the first insulative layer 221 and the second conducting layer 212. The second conducting layer 212 and the second upper electrodes 2121 are made by a one-step processing process and bonded to the bottom surface of the top membrane layer 3 opposite to the elastic layer 31. Further, the first conducting layer 211 and the bottom electrode 2111 are made from silver paste by a one-step processing process, having a thickness in the range of 0.01~0.05 mm. The first insulative layer 221 can be made from UV curable rubber, having a thickness in the range of 0.01~0.05 mm. The light-emitting layer 23 is an electroluminescent sheet containing phosphorous or zinc sulfide (ZnS) and made by printing, having a thickness in the range of 0.01~0.05 mm. The second conducting layer 212 and the second upper electrodes 2121 can be transparent electrode using anisotropic conductive films (ACFs), or a transparent indium tin oxide (ITO) electrode made by vacuum sputtering deposition technology, having a thickness in the range of 0.01~0.05 mm. As the component layers of the intermediate membrane layer 2 are made in the range of 0.01~0.05 mm, the overall thickness of the intermediate membrane layer 2 can be controlled. After mounting of a set of keys 33 on the top surface of the elastic layer 31 of the top membrane layer 3, the bottom membrane layer 1, the intermediate membrane layer 2 and the top membrane layer 3 are tightly arranged together so that the bottom membrane layer conducting layer 11 of the bottom membrane layer 1, the conducting layer 21 of the intermediate membrane layer 2 and the light-emitting layer 23 are sealed in between the bottom membrane layer 1 and the top membrane layer 3 in a watertight manner, preventing permeation of damp and mould into the inside of the intermediate membrane layer 2 and achieving an optimal waterproof effect.

If one key 33 at the top surface of the top membrane layer 3 is pressed by an external force, the key 33 gives a downward pressure to the respective rubber dome of the elastic layer 31, forcing one respective second upper electrode 2121 to touch the respective bottom electrode 2111, producing a switching signal corresponding to the respective key 33.

In conclusion, the invention provides a low profile keyboard backlight module, which comprises a bottom membrane layer 1, an intermediate membrane layer 2 and a top membrane layer 3 arranged in a stack through lamination, wherein the intermediate membrane layer 2 comprises a conducting layer 21, and insulative layer 22 and a light-emitting layer 23 arranged in a stack through lamination. By means of arranging the bottom membrane layer 1, the intermediate membrane layer 2 and the top membrane layer 3 in a stack through lamination, the overall thickness of the backlight module is minimized, and thus, the low profile keyboard backlight module is practical for use in an electronic produce having light, thin, short and small characteristics. Further, because the intermediate membrane layer 2 is surrounded by the bottom membrane layer 1 and the top membrane layer 3, the conducting layer 21, light-emitting layer 23 of the intermediate membrane layer 2 and the conducting circuit layer 32 of the top membrane layer 3 are kept from sight and well protected against damp and mould.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A low profile keyboard backlight module, comprising a bottom membrane layer, a top membrane layer and an intermediate membrane layer sandwiched between said bottom membrane layer and said top membrane layer, wherein:

said bottom membrane layer is an electrically insulative layer;

said intermediate membrane layer is laminated on a top surface of said bottom membrane layer, comprising a conducting layer, an insulative layer and a light-emitting layer attached together through lamination, wherein the conducting layer comprises a first conducting layer, a second conducting layer, a plurality of bottom electrodes integrally formed on the top surface of the bottom membrane layer and a plurality of second upper electrodes bonded to a bottom surface of the top membrane layer with the plurality of second upper electrodes respectively disposed corresponding to the respective plurality of bottom electrodes;

said top membrane layer is an electrically insulative layer bonded to a top surface of said intermediate membrane layer opposite to said bottom membrane layer, comprising an elastic layer located at a top surface thereof and supporting a set of keys;

wherein the first conducting layer and the plurality of bottom electrodes are made by a one-step processing process, the second conducting layer and the plurality of second upper electrodes are made by a one-step processing process;

wherein when the plurality of second upper electrodes are forced, the plurality of second upper electrodes will touch the respective plurality of bottom electrodes.

2. The low profile keyboard backlight module as claimed in claim 1, wherein said bottom membrane layer is made from non-stick coating polyester film.

3. The low profile keyboard backlight module as claimed in claim 2, wherein said first conducting layer is made from silver paste, having a thickness in the range of 0.01~0.05 mm; said first insulative layer and said second insulative layer are made from UV curable rubber, having a thickness in the range of 0.01~0.05 mm; said light-emitting layer is an electroluminescent sheet containing one of phosphorous and zinc sulfide (ZnS) and made by printing, having a thickness in the range of 0.01~0.05 mm; said second conducting layer is a transparent electrode using anisotropic conductive films (ACFs), or a transparent indium tin oxide (ITO) electrode made by vacuum sputtering deposition technology, having a thickness in the range of 0.01~0.05 mm.

4. The low profile keyboard backlight module as claimed in claim 1, wherein said conducting layer of said intermediate membrane layer comprises a first conducting layer bonded to the top surface of said bottom membrane layer and a second conducting layer bonded to a bottom surface of said top membrane layer and a top surface of said light-emitting layer; said insulative layer of said intermediate membrane layer comprises a first insulative layer bonded between a bottom surface of said light-emitting layer opposite to said second conducting layer and a top surface of said first conducting layer opposite to said bottom membrane layer; said light-emitting layer is bonded between said first insulative layer and said second conducting layer.

5. The low profile keyboard backlight module as claimed in claim 4, wherein said first conducting layer is made from silver paste, having a thickness in the range of 0.01~0.05 mm; said first insulative layer is made from UV curable rubber, having a thickness in the range of 0. 01~0.05 mm; said light-emitting layer is an electroluminescent sheet containing one of phosphorous and zinc sulfide (ZnS) and made by printing, having a thickness in the range of 0.01~0.05 mm; said second conducting layer is a transparent electrode using anisotropic conductive films (ACFs), or a transparent indium tin oxide (ITO) electrode made by vacuum sputtering deposition technology, having a thickness in the range of 0.01~0.05 mm.

6. The low profile keyboard backlight module as claimed in claim 1, wherein said top membrane layer is made from non-stick coating polyester film; said elastic layer comprises an array of rubber domes adapted for supporting said keys respectively and respectively elastically compressible by said keys.

* * * * *